US006862992B2

(12) United States Patent
Nakazawa et al.

(10) Patent No.: US 6,862,992 B2
(45) Date of Patent: Mar. 8, 2005

(54) METHOD OF LITHOGRAPHIC PRINTING

(75) Inventors: Yusuke Nakazawa, Shizuoka (JP); Kazuo Ishii, Shizuoka (JP); Eiichi Kato, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/396,238

(22) Filed: Sep. 15, 1999

(65) Prior Publication Data

US 2002/0170451 A1 Nov. 21, 2002

(30) Foreign Application Priority Data

Sep. 25, 1998 (JP) ..... 10-271708
Jan. 14, 1999 (JP) ..... 11-008104

(51) Int. Cl.[7] ..... B41C 1/10
(52) U.S. Cl. ..... 101/466; 347/55; 347/102
(58) Field of Search ..... 101/463.1, 465–467, 101/425; 347/29, 32, 55, 84, 85, 88, 89, 102

(56) References Cited

U.S. PATENT DOCUMENTS 4,130,126 A * 12/1978 Chocholaty et al. ..... 137/3
4,555,712 A * 11/1985 Arway et al. ..... 347/89
4,718,340 A * 1/1988 Love, III ..... 101/467
4,846,065 A * 7/1989 Mayrhofer et al. ..... 101/453
5,322,015 A * 6/1994 Gasparrini ..... 101/425
5,363,132 A * 11/1994 Ikkatai ..... 347/29
5,582,106 A * 12/1996 Kanda et al. ..... 101/462
5,852,453 A * 12/1998 Hirahara et al. ..... 347/55
5,852,975 A * 12/1998 Miyabe et al. ..... 101/463.1
5,911,815 A * 6/1999 Yamamoto et al. ..... 106/31.27
5,936,008 A * 8/1999 Jones et al. ..... 523/161
5,952,048 A * 9/1999 Tsubuko et al. ..... 427/288
5,988,782 A * 11/1999 Miura et al. ..... 347/100
6,120,655 A * 9/2000 Ishii et al. ..... 101/463.1

FOREIGN PATENT DOCUMENTS

EP 0641648 A 3/1995
JP 56113456 A 9/1981
JP 58147373 A 9/1983
JP 204355 * 8/1998
JP 10202822 A 8/1998
JP 10-203039 * 8/1998
JP 10219163 A 8/1998
JP 10251580 A 9/1998

OTHER PUBLICATIONS

Computer translation of JP 10–203,039.*

* cited by examiner

*Primary Examiner*—Stephen R. Funk
(74) *Attorney, Agent, or Firm*—Sughrue Mion, PLLC

(57) ABSTRACT

A method of lithographic printing is disclosed, which includes forming an image based on signals of image data directly on a printing plate precursor mounted on a plate cylinder of a printing press, thereby preparing a printing plate, and conducting lithographic printing, wherein the formation of the image on the printing plate precursor is carried out by an ink jet recording method in which oil-based ink is ejected utilizing an electrostatic field.

17 Claims, 7 Drawing Sheets

METHOD OF LITHOGRAPHIC PRINTING

FIELD OF THE INVENTION

The present invention relates to a method of lithographic printing in which digital plate-making is performed in a printing press. More particularly, the present invention relates to a method of lithographic printing in which oil-based ink is employed for plate-making and which provides images having an excellent image quality both on a lithographic printing plate and on prints.

BACKGROUND OF THE INVENTION

In the field of lithographic printing, ink receptive areas and ink repellent areas are formed on the surface of a printing plate in accordance with an original image, and printing ink adheres to the ink receptive areas to conduct printing. Ordinarily, hydrophilic areas and oleophilic (ink repellent) areas are formed imagewise on the surface of a printing plate, and the hydrophilic areas are rendered ink repellent by applying dampening water thereto.

In a conventional manner, image formation on a printing plate (plate-making) is carried out by outputting an original image to a silver halide photographic film in an analog or digital manner, exposing a photosensitive material (printing plate precursor) containing a diazo resin or a photopolymerizable polymer through the silver halide photographic film, and removing by dissolving out the non-image areas mainly using an alkaline solution.

Recently, various methods in which digital image information is directly recorded to a printing plate precursor have been proposed in the field of lithographic printing with the improvement in digital recording technology and the requirement for performing a printing process more efficiently. These methods include technologies referred to as the CTP (computer-to-plate) method and the DDPP (digital direct printing plate) method. For instance, an image recording system by photon mode or heat mode using a laser beam is known for plate-making and partially utilized in practice.

However, such a plate-making method usually includes treatment with an alkaline developer for removing by dissolving out the non-image areas after image recording by photon mode or heat mode using a laser beam and thus, is accompanied with discharge of alkaline waste liquor which is undesirable in view of environmental conservation.

In order to perform the printing process more efficiently, a system in which the image recording is conducted in a printing press is also known. However, an expensive and huge apparatus is necessary in case of using the laser beam as described above. Therefore, a system utilizing an ink jet recording method using an inexpensive and compact recording device has been attempted.

Furthermore, JP-A-4-97848 (the term "JP-A" as used herein means an "unexamined published Japanese patent application") describes a printing method in which a plate drum having a hydrophilic or oleophilic surface is installed in a printing press instead of a conventional plate cylinder, oleophilic or hydrophilic images are formed on the plate drum by means of an ink jet recording method, and after lithographic printing operation, the images are removed to clean the plate drum. The printing method, however, has a problem in that printing durability of the plate drum is inconsistent with the removal of images from the plate drum after the printing operation (i.e., easiness of the cleaning). Further, since a resin solution is employed as ink in the ink jet recording method for forming the images on the plate drum, the resin tends to deposit in a nozzle due to evaporation of the solvent so that ejection of ink becomes unstable. Therefore, it is difficult to obtain images of good quality.

SUMMARY OF THE INVENTION

The present invention has been made in order to overcome the problems described above.

Specifically, an object of the present invention is to provide a method of lithographic printing which responds to a digital recording system and in which development processing is not used for forming a printing plate.

Another object of the present invention is to provide a method of lithographic printing which is capable of providing a large number of prints having clear images in a simple manner without using expensive apparatus.

Other objects of the present invention will become apparent from the following description.

It has been found that these objects of the present invention are accomplished by a method of lithographic printing which includes forming an image based on signals of image data directly on a printing plate precursor mounted on a plate cylinder of a printing press, thereby preparing a printing plate, and conducting lithographic printing, wherein the formation of an image on the printing plate precursor is carried out by an ink jet recording method in which oil-based ink is ejected utilizing an electrostatic field.

The numerical symbols in FIGS. 1 to 10 represent the following:

| | |
|---|---|
| 1 | Lithographic printing press forming lithographic, printing plate therein |
| 2 | Ink jet recording device |
| 3 | Dampening water supplying device |
| 4 | Printing ink supplying device |
| 5 | Fixating device |
| 6 | Plate surface desensitizing device |
| 7 | Automatic plate supplying device |
| 8 | Automatic plate discharging device |
| 9 | Plate (Printing plate precursor) |
| 10 | Dust-removing device |
| 11 | Plate cylinder |
| 12 | Blanket cylinder |
| 13 | Impression cylinder |
| 14 | Blanket-cleaning device |
| 15 | Dust generation preventing device |
| 21 | Arithmetic and control unit of image data |
| 22 | Ejection head |
| 221 | Upper unit of ejection head |
| 222 | Lower unit of ejection head |
| 22a | Ejection slit |
| 22b | Ejection electrode |
| 23 | Oil-based ink |
| 24 | Ink supplying part |
| 25 | Ink tank |
| 26 | Ink supplying device |
| 27 | Stirring device |
| 28 | Means for controlling ink temperature |
| 29 | Means for controlling ink concentration |
| 30 | Encoder |
| 31 | Device for moving the head near or away |
| 32 | Head sub-scanning means |
| 33 | First insulating substrate |
| 34 | Second insulating substrate |
| 35 | Slope of the second insulating substrate |
| 36 | Top face of the second insulating substrate |
| 37 | Ink inflow course |
| 38 | Ink recovery course |
| 39 | Backing |
| 40 | Groove |
| 41 | Body of a head |
| 42, 42' | Meniscus regulation boards |
| 43 | Ink groove |
| 44 | Partition |
| 45, 45' | Ejection part |
| 46 | Partition |
| 47 | Tip of partition |
| 50, 50' | Support members |
| 51, 51' | Grooves |
| 52 | Partition |
| 53 | Upper end part |
| 54 | Rectangular part |
| 55 | Top part of partition |
| 56 | Guide protrusion |
| P | Printing paper |

DETAILED DESCRIPTION OF THE INVENTION

The method of the present invention is illustrated below in detail.

The present invention is characterized in that the formation of an image is carried out by an ink jet recording method in which an oil-based ink is ejected utilizing an electrostatic field on a plate (printing plate precursor) mounted on a plate cylinder of a printing press.

In the method of the present invention, the size of the ink droplet ejected is determined by the size of an ejection electrode. Although the electrode used is small in size, fine ink droplets can be formed without reducing the nozzle diameter and the ejection slit width. Thus, control of fine image can be affected without the occurrence of clogging in the head. As a result, the lithographic printing method of the present invention can provide a large number of prints with clear images.

One example of a lithographic printing press capable of forming lithographic printing plates therein which can be used for carrying out the present lithographic printing method of the present invention is given below.

Figure 1:
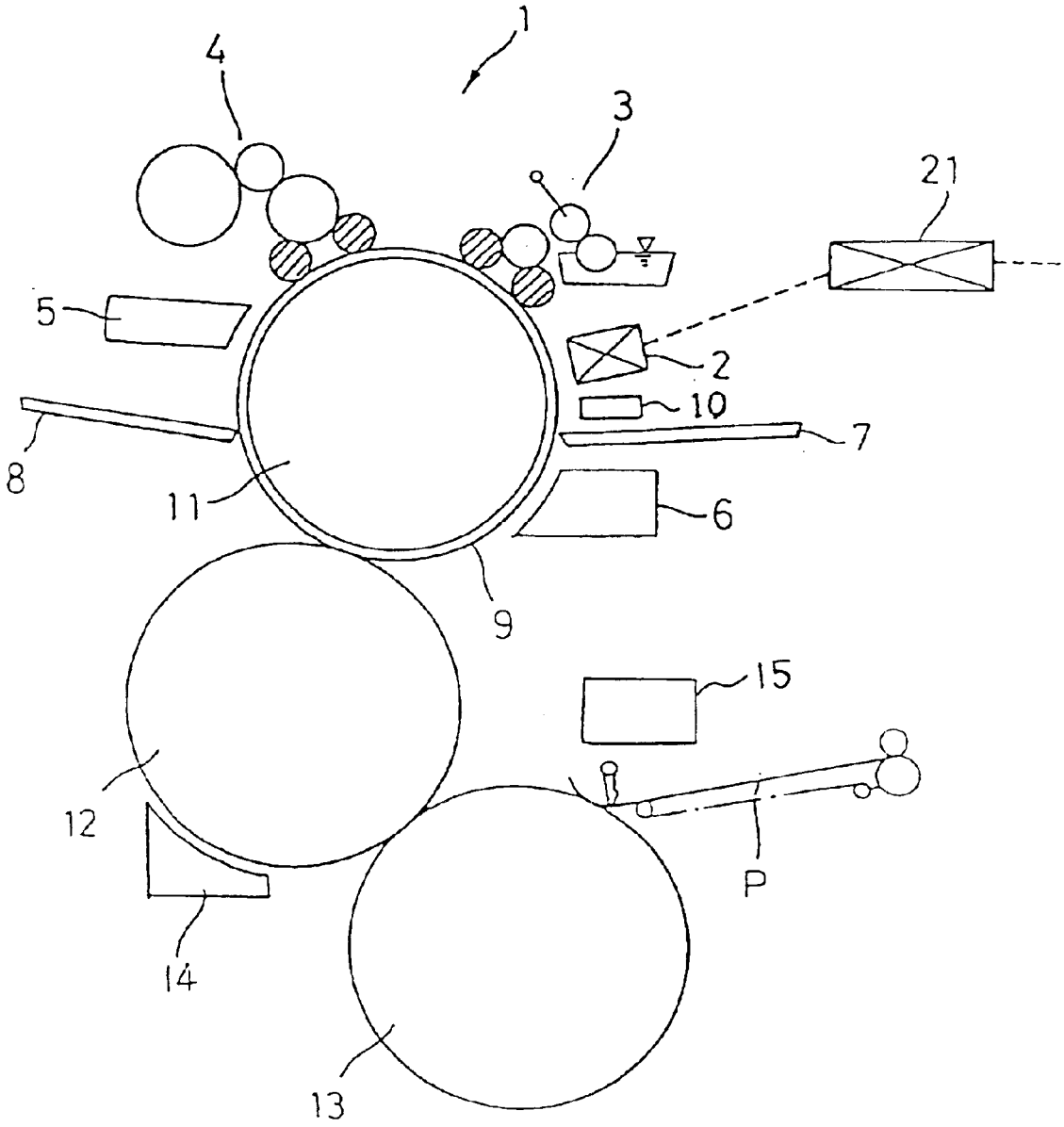
FIG. 1 is a side view showing one embodiment of a lithographic printing press forming a lithographic printing plate therein which can be used to perform the method of the present invention.
Figure 2:
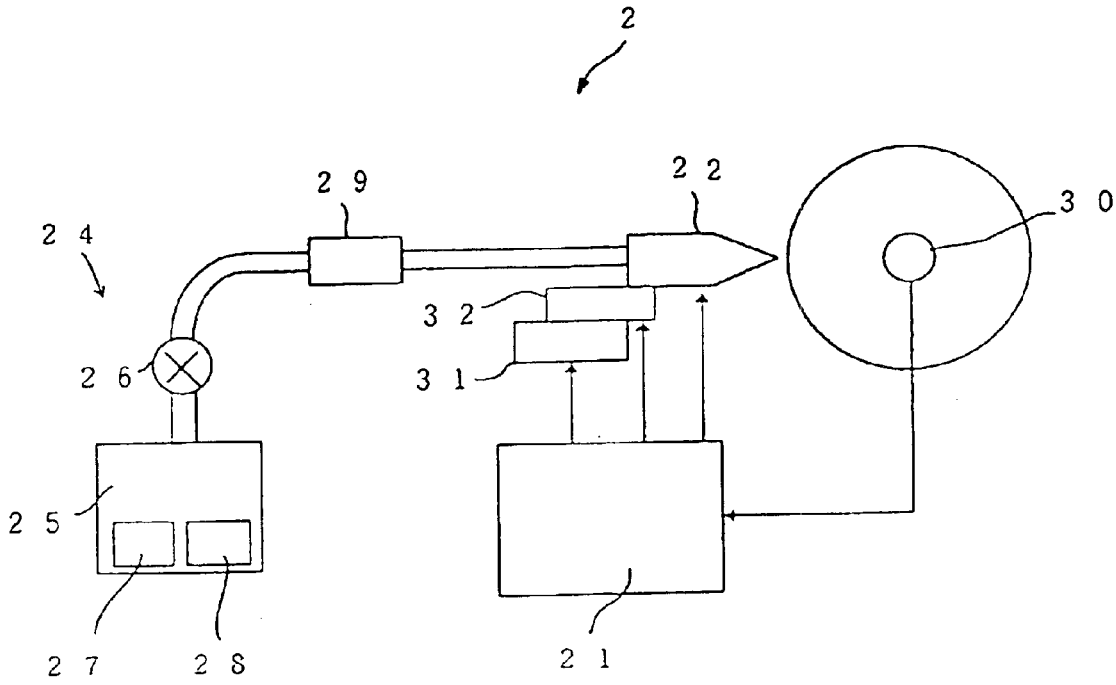
FIG. 2 is a schematic view showing an example of a drawing part which can be used to perform the method of the present invention.

FIG. 1 is an overall structural view showing a single-color one-sided lithographic printing press forming a lithographic printing plate therein. FIG. 2 is a schematic structural view of one example of the drawing part including a controlling part, an ink supplying part and a mechanism for moving a head near or away in the lithographic printing press to form a lithographic printing plate therein of the present invention. FIGS. 3 to 9 are schematic views illustrating an ink jet recording device which is equipped in the lithographic printing press forming a lithographic printing plate therein shown in FIGS. 1 and 10. Furthermore, FIG. 10 is a schematically overall structural view showing an example of the four-color one-sided lithographic printing press forming a lithographic printing plate therein usable in the invention.

Now, the printing process according to this invention is illustrated by the use of the overall structural view of the single-color one-sided lithographic printing press forming a lithographic printing plate therein shown in FIG. 1.

As shown in FIG. 1, the lithographic printing press forming a lithographic printing plate therein 1 (abbreviated as "printing press" hereinafter) has one plate cylinder 11, one blanket cylinder 12 and one impression cylinder 13. Further, the blanket cylinder 12 for transfer use is arranged so that it is brought into pressure contact with the plate cylinder 11 at least in the course of the lithographic printing operation and it is also brought into pressure contact with the impression cylinder 13 so that the printing ink images transferred onto the blanket cylinder are further transferred to printing paper P.

The plate cylinder 11 is generally made of metal, and the surface thereof is plated with chromium or the like for the purpose of increasing abrasion resistance. Optionally, as described below, it may have a heat insulator on the surface. Further, it is desirable for the plate cylinder 11 to be grounded because the plate cylinder acts as a counter electrode to the electrode of the ejection head under the electrostatic field ejection. When the substrate of a plate (i.e., a printing plate precursor) is a good insulator, it is desirable to provide a conductive layer thereon. In this case, it is advisable to connect the conductive layer to the plate cylinder with a grounding means. In the optional case where the heat insulator is provided on the plate cylinder, the drawing becomes easy by providing the printing plate precursor with a grounding means. Examples of a grounding means for use therein include known conductive brushes, leaf springs and rollers.

The printing press 1 has an ink jet recording device 2. This device ejects out oil-based ink onto the printing plate precursor 9 mounted on the plate cylinder 11 in accordance with image data transmitted from an image data arithmetic and control unit of image data 21, thereby forming a printing area on the printing plate precursor.

Further, the printing press 1 is provided with a dampening water supplying device 3, and thereby the dampening water is supplied to the hydrophilic area (non-image) area. In FIG. 1, Morton's water-supplying system is shown as a typical example of the dampening water supplying device 3. However, other known water-supplying systems, such as a Dahlgren dampening system and a continuous water-supplying system, can also be used. Furthermore, the printing press 1 has a printing ink supplying device 4 and a fixing device 5 for firmly adhering the oil-based ink image drawn on the printing plate precursor 9. In addition, a plate surface desensitizing device 6 may be installed depending on the printing plate precursor 9 used, if it is needed for increasing the hydrophilic property of the surface of the printing plate precursor 9. Besides these devices, the printing press 1 has a dusting-off device 10 for removing dust present on the printing plate precursor surface before and/or during drawing images on the printing plate precursor. In the course of plate-making, this device can effectively prevent the ink from adhering to the printing plate precursor via the dust having gotten between the head and the printing plate precursor. As a result, satisfactory plate-making can be accomplished. Examples of dust-removing means include in addition to conventional non-contact methods, such as removal by suction, removal by blowing-off and electrostatic removal, contact methods using a brush and a roller respectively. Preferably, removal by air suction, removal by blowing-off with air or the combination thereof is used in this invention. Thereto, the air pump generally used for a paper sheet feeder can be also used.

Further, therein may be installed an automatic printing plate precursor supplying device 7, by which a printing plate precursor 9 to be subjected to printing is fed automatically to the plate cylinder 11, and an automatic printing plate precursor discharging device 8 by which the printing plate precursor 9 after undergoing the printing operation is removed from the plate cylinder 11. Examples of a printing press having such devices well-known as its supplementary means include Hamada VS 34A and B452A (made by Hamada Insatsu K.K.), Toko 8000 PFA (made by Tokyo Kouku Keiki K.K.), Ryobi 3200ACD and 3200 PFA (made by Ryobi Imagix Co., Ltd.), AMSIS Multi 5150FA (Nippon AM Co. Ltd.), Oliver 266EPZ (made by Sakurai Graphic Systems Co., Ltd.) and Shinohara 66IV/IVP (made by Shinohara Shoji Co., Ltd.). Furthermore, a blanket cleaning device 14 may be installed. The use of these devices 7, 8 and 14 can make the printing operation simpler and the printing time shorter so that the effects of this invention can be further enhanced. In the neighborhood of the impression cylinder 13, a dust generation-preventing device 15 may be installed too. This device protects the printing plate precursor surface from suffering from the adhesion of paper dust. In the dust generation-preventing device 15, the methods of controlling humidity and using air or electrostatic suction can be applied.

The arithmetic and control unit of image data 21 receives image data from, for example, an image scanner, a magnetic disk device or an image data communication device, and not only carries out color separation but also divisional arithmetic of the separated data into appropriate numbers of pixels and gradations. In addition to these operations, the control part 21 performs the arithmetic of dot area percentage in order to enable the drawing of an oil-based ink image in halftone dots by means of an ejection head 22 (See FIG. 2 explained in detail hereinafter) with which the ink jet recording device is equipped.

Furthermore, as described below, the arithmetic and control unit of image data 21 controls the movement of ejection head 22 and the time at which the oil-based ink is ejected out and, if needed, the timing of individual cylinders' workings.

The process for preparing a lithographic printing plate with the printing press 1 is illustrated below by reference to FIG. 1 and a part of FIG. 2.

In the first place, the printing plate precursor 9 is mounted on the plate cylinder 11 by the use of the automatic printing plate precursor supplying device 7. At this time, the printing plate precursor is brought into close contact with and fixed firmly to the plate cylinder by means of a well-known mechanical device, such as a plate end gripping device, an air suction device, or a well-known electrostatic device. By this firm fixation, the plate end is prevented from flapping against the ink jet recording device 2 to be damaged during the drawing. Also, it is possible to prevent the printing plate precursor from scraping against the ink jet recording device by arranging means for bringing the printing plate precursor into close contact with the plate cylinder only in the neighborhood of the drawing position of the ink jet recording device and running the means at least during the drawing. Specifically, the means maybe, for example, hold-down rollers disposed on both upstream and downstream sides of the drawing position on the plate cylinder. Further, means for protecting the plate end from contact with an ink supplying roller in the step of fixing the plate is attached to the printing press, and thereby the plate surface can be prevented from developing scum and the spoilage can be decreased. Suitable examples of such means include a hold-down roller, a guide and electrostatic adsorption.

The image data from, for example, a magnetic disk device are fed to the arithmetic and control unit of image data 21, and therein the operations for the arithmetic of ejection positions of oil-based ink and the dot area percentages at the respective positions are performed in accordance with the input image data. For a time, this arithmetic data is stored as buffer. The arithmetic and control unit of image data 21 makes the plate cylinder 11 rotate and, at the same time, switches on the device 31 for moving the head near and away to make the ejection head 22 approach the position close to the plate cylinder 11. The distance between the ejection head 22 and the surface of the printing plate precursor 9 mounted on the plate cylinder 11 is kept at the desired value during the drawing by mechanical distance control, e.g., using a contact roller, or by controlling the device 31 based on the signals from an optical distance detector. This distance control makes it possible to prevent irregularity in dot diameter due to looseness of the printing plate precursor. In particular, it can ensure no change in dot diameter even when the vibration is applied to the printing press. Therefore, satisfactory plate-making can be accomplished.

A single head, a multiple head or a full line head can be used as ejection head 22. The main scanning is carried out by rotating the plate cylinder 11. In the case of a multiple or full line head having a plurality of ejection parts, the head is arranged so that these parts are aligned in the axis direction of the plate cylinder. In the case of a single or multiple head, according to the orders from the arithmetic and control unit of image data 21, the head is further moved in the direction parallel to the rotation axis at every time the plate cylinder rotates. Towards the printing plate precursor 9 mounted on plate cylinder 11, oil-based ink is ejected out from the head in the position and with the dot area percentage determined by the operations performed in the unit 21. As a result, the halftone image corresponding to the gradation of an original is drawn in oil-based ink on the printing plate precursor 9. These workings are continued until the oil-based ink image corresponding to single-color information of the original is formed on the printing plate precursor to complete the printing plate. In the case of a full line head having almost the same length as the width of the plate cylinder, however, the oil-based ink image corresponding to single-color information of the original is formed on the printing plate precursor by one rotation of the plate cylinder to complete the printing plate. As mentioned above, the plate cylinder is rotated to effect the main scanning so that the positional precision in the main scanning direction is enhanced and high-speed drawing becomes feasible.

Then, ejection head 22 is moved away from the position close to the plate cylinder 11 for protection purposes. At the conclusion of the drawing, ejection head 22, though it may be moved away by itself, can also be moved away together with a head sub-scanning means 32. On the other hand, the ejection head 22, the ink supplying part 24 and the head sub-scanning means 32 may be moved away at the same time, too. In addition to these members of the printing press, the fixing device 5 and the dust-removing device 10 each may be made withdrawable by having means for moving near and away. In this case, the printing press is adaptable for conventional printing use.

While the drawing operation is suspended, the means for moving the head near and away works so as to keep the head at least 500 m a way from the plate cylinder. This movement may be made by a sliding system or in a way that the head is gripped with the arm fixed on a shaft and moved like a swing of a pendulum by turning the shaft. By withdrawing the head while the drawing operation is not performed, the head is protected from physical damage and contamination. As a result, the life of the head can be prolonged.

Further, the oil-based ink image formed is strengthened with a fixing device 5. As a means for fixing ink, well-known means of, for example, heating fixation, solvent fixation and flash exposure fixation can be employed. In the case of heating fixation, irradiation with a halogen lamp or the hot-air or heat-roll fixation using a heater is generally carried out. In this case, it is effective for heightening the fixing efficiency to adopt such a measure as to previously heat the plate cylinder, previously heat the printing plate precursor, perform the drawing under exposure to hot air, use the plate cylinder coated with a heat insulator, or heat the printing plate precursor alone by separating the printing plate precursor from the plate cylinder only upon fixation. These measures may be adopted in combination to two or more thereof.

In the case of solvent fixation, the solvent capable of dissolving the resin component of the ink, such as methanol or ethyl acetate, is sprayed and the excess solvent vapor is recovered.

Furthermore, flash fixation using, for example, a xenon lamp, is well-known as a fixation method for electrophotographic toner, and has an advantage of being short in fixation time. Additionally, it is desirable that, at least during the process of the formation of an oil-based ink image by means of an ejection head 22 to the fixation with the fixing device 5, the printing plate precursor 9 on the plate cylinder be kept so as to have no contact with the dampening water supplying device 3, the printing ink supplying device 4 and the blanket cylinder 12.

The printing process after forming the printing plate is the same as well-known lithographic printing processes. More specifically, printing ink and dampening water are applied to the printing plate precursor 9 on which the oil-based ink image is drawn thereby forming the printing image. The printing image thus formed is transferred onto blanket cylinder 12 rotating in concert with plate cylinder 11, and then the printing ink image on the blanket cylinder is transferred to printing paper P passing between blanket cylinder 12 and impression cylinder 13 to finish the printing corresponding to single-color information of the original. The printing plate precursor 9 after printing is removed from the plate cylinder 11 by means of a printing plate precursor auto-releasing device 8, and the blanket on the blanket cylinder 12 is cleaned with a blanket cleaning device 14 to be restored to the printable state.

The ink jet recording device 2 is illustrated below.

The drawing part used for the lithographic printing press of the present invention, as shown in FIG. 2, includes an ejection head 22 and an ink supplying part 24. Further, the ink supplying part 24 has an ink tank 25, an ink supplying device 26 and means for controlling ink concentration 29. The ink tank 25 is furnished with a stirring means 27 and means for controlling ink temperature 28. The ink may be circulated through the head. In this case, the ink supplying part 24 has a recovering function in addition to the circulatory function. The stirring means 27 inhibits the solid component of the ink from precipitating and aggregating to reduce the necessity for cleaning the ink tank 25. Examples of means 27 for stirring the ink include a rotating blade, an ultrasonic vibrator and a circulatory pump. These tools can be used alone or in combination. The means for controlling ink temperature 28 is arranged so as to inhibit the physical properties of ink from changing due to a change in temperature of the surroundings, thereby ensuring no change in dot diameter to a form high-quality image. For the means for controlling the ink temperature, any well-known system can be used. More specifically, the ink tank 25 is furnished with a heating element, such as a heater or Peltier element, or a cooling element together with a stirring means so as to make the temperature distribution inside the ink tank 25 uniform, and the temperature is controlled with a temperature sensor, such as a thermostat. Additionally, it is desirable that the ink temperature inside the ink tank 25 be from 15° C. to 60° C., preferably from 20° C. to 50° C. The stirring means 27 may be used for both purposes of keeping the temperature distribution uniform and preventing the precipitation and aggregation of the solid component of the ink.

For achieving a high-quality drawing, it is desirable that the printing press of the present invention farther has a means for controlling ink concentration 29. This means 29 makes it possible to effectively prevent blur on the printing plate precursor 9 and generation of a disappearance of the printed image due to the decrease of solid concentration in the ink, or change of the dot diameter due to the increase of the solid concentration in the ink. The ink concentration control is carried out by optical detection, measurements of physical properties, such as electric conductivity and viscosity, or monitoring the number of drawings. More specifically, the ink concentration is controlled by feeding a concentrated ink from an ink tank 25 for replenishment (which is not shown in FIG. 2) or a diluent from an ink carrier tank for dilution (which is not shown in FIG. 2) in accordance with output signals from an optical detector, a conductivity measuring instrument and a viscosity measuring instrument set inside the ink tank 25 or the ink inflow course independently or in combination in the case of control by measurements of physical properties, or based on the number of plate made sheet or the frequency of plate-making operations in the case of monitoring the number of drawings.

The arithmetic and control unit of image data 21, as described above, not only performs arithmetical operations of input image data and a device for moving the head near or away 31 or the head sub-scanning means 32, but also takes in timing pulses from the encoder 30 attached to the plate cylinder and carries out operations of the head in accordance with the timing pulses. As a result, the positional precision in the sub-scanning direction is heightened. On the other hand, the positional precision in the sub-scanning direction can also be heightened by driving the plate cylinder by the use of a high-precision driving means, which is different from a driving means used upon printing, in the course of drawing with the ink jet recording device. In this case, it is desirable that the plate cylinder be mechanically isolated from the blanket cylinder, the impression cylinder and others and driven independently. Specifically, the output of a high-precision motor is decelerated with a high-precision gear or a steel belt, and thereby, the plate cylinder alone is driven. In achieving the drawing of high-quality images, these means are used individually or as a combination of two or more thereof.

The ejection head 22 is illustrated using FIGS. 3 to 9. However, the scope of the invention should not be construed as being limited to the following description.

Figure 3:
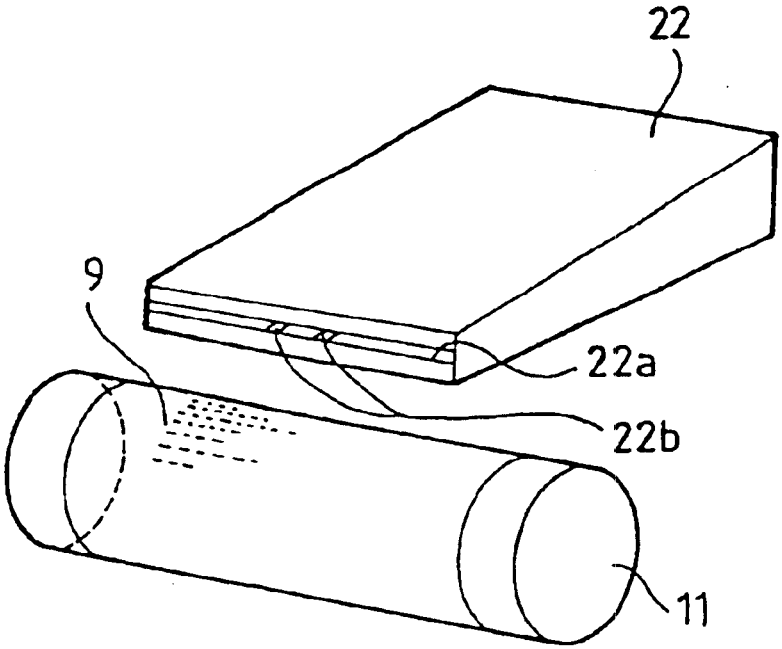
FIG. 3 is a rough sketch showing a head which is equipped in the ink jet recording device which can be used in the method of the present invention.
Figure 4:
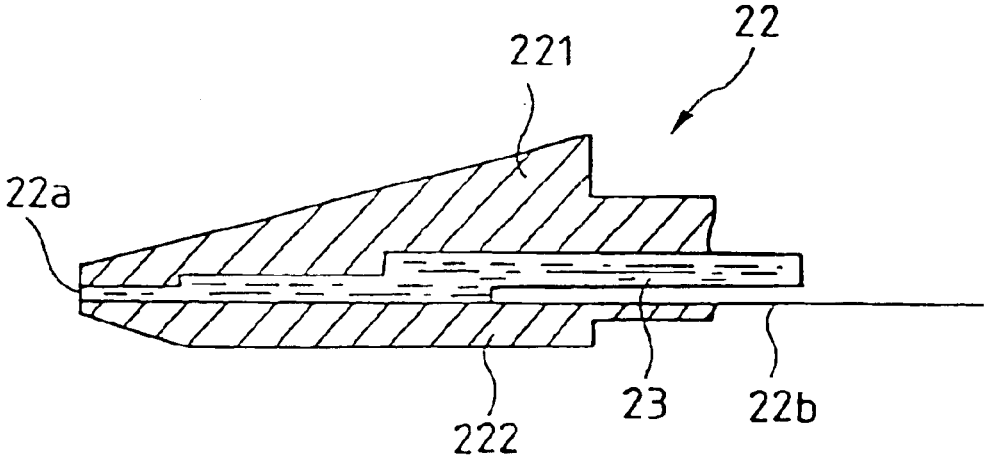
FIG. 4 is a schematically sectional view illustrating the ink jet area of the head shown in FIG. 3.

FIG. 3 and FIG. 4 show an example of the head 22 with which the present ink jet recording device 2 is equipped. The head 22 has a slit interposed between the upper and lower units 221 and 222 made of an insulating material, and the tip thereof forms an ejection slit 22*a* The ejection electrode 22*b* is arranged in the slit, and the slit is filled with the oil-based ink 23 supplied from the ink supplying device. Examples of an insulating material usable therein include a plastic, glass and a ceramic. The ejection electrode 22*b* is formed on the lower unit 222 made of an insulating material according to a known method. For instance, the top surface of the lower unit 222 is coated with a conductive material, such as aluminum, nickel, chromium, gold or platinum, by vacuum deposition, sputtering or an electroless plating technique, and further coated with a photoresist. The photoresist is exposed to light via the desired electrode pattern and developed to form the photoresist pattern for the ejection electrode 22*b*. Further, the metal coating undergoes etching, mechanical removal or the combination thereof to form the ejection electrode 22*b*.

Voltage is applied to the ejection electrode 22*b* in accordance with the digital signals of image pattern information. As shown in FIG. 3, the ejection electrode 22*b* is arranged facing the plate cylinder 11 to constitute a counter electrode, and the printing plate precursor 9 is mounted on the plate cylinder 11 as a counter electrode. By applying the voltage, a circuit is formed between the ejection electrode 22*b* and the plate cylinder 11 as a counter electrode, and thereby the oil-based ink 23 is ejected out from the ejection slit 22*a* of the head 22 to form images on the printing plate precursor 9 mounted on the plate cylinder 11 as a counter electrode.

From the standpoint of high-quality image formation, it is desirable that the tip of the ejection electrode 22*b* be made as narrow as possible. The tip of the electrode is generally shaped so as to have a width of from 5 to 100 m although the tip width depends on conditions.

For example, the dots having a diameter of 40 m can be formed on the printing plate precursor 9 when the ejection electrode 22*b* having a tip width of 20 m is used, the space between the ejection electrode 22*b* and the plate cylinder 11 as a counter electrode is adjusted to 1.0 mm and the voltage of 3 KV is applied for 0.1 millisecond between these electrodes.

Figure 5:
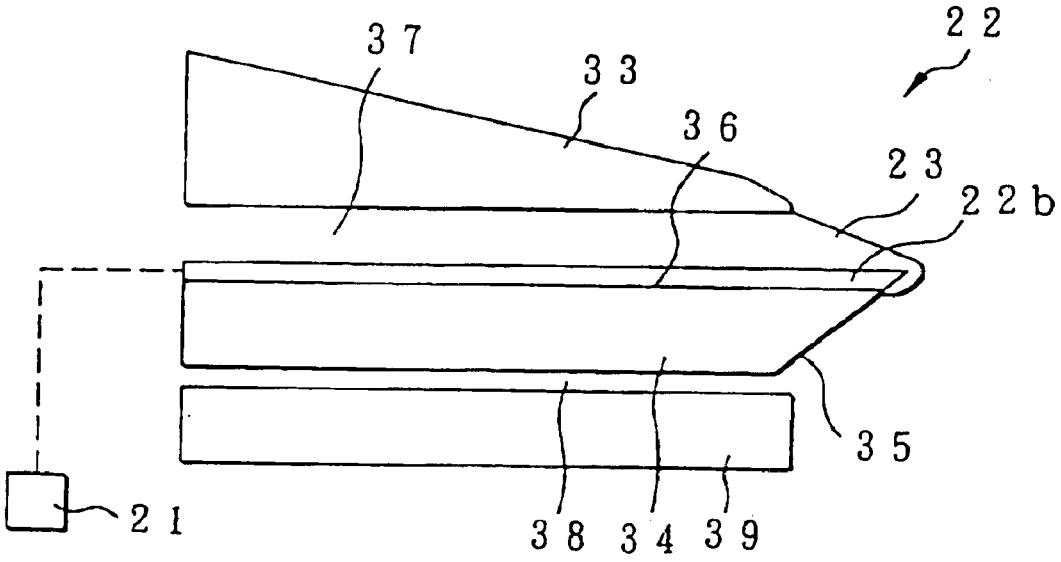
FIG. 5 is a schematically sectional view illustrating the ink jet area of another example of a head which is equipped in the ink jet recording device of the invention.
Figure 6:
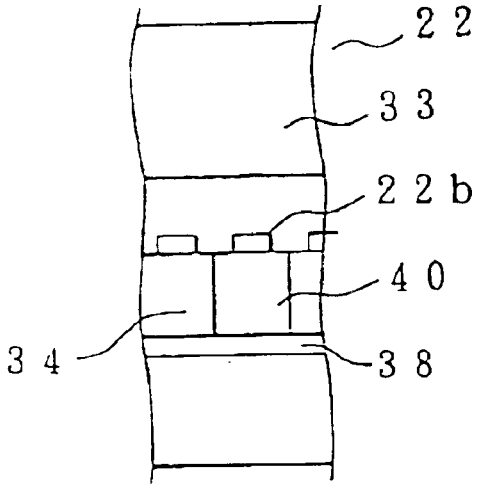
FIG. 6 is a front-side schematic view of the ink jet area shown in FIG. 5.

The schematically sectional view and the front-side schematic view of another example of the ejection head are shown in FIGS. 5 and 6 respectively. The numeral 22 in the figures stands for the ejection head, and this head has the first insulating substrate 33 of a tapered shape. The second insulating substrate 34 is set facing to and apart from the first insulating substrate 33. The tip part of the second insulating substrate 34 has a slope 35. The first and second insulating substrates 33 and 34, respectively, are each made of, for example, a plastic, glass or a ceramic. On the top surface 36 of the second insulating substrate 34, which makes a sharp angle with the slope 35, a plurality of ejection electrodes 22*b* are provided as means for forming an electrostatic field in the ejection part. The tip parts of these ejection electrodes 22*b* are extended to the vicinity of the tip of the top surface 36, and protrudes forward from the tip of the first insulating substrate 33 thereby forming the ejection part. The ink inflow course 37, as a means for supplying the ink 23 to the ejection part, is formed between the first and the second insulating substrates 33 and 34, respectively, and the ink recovery course 38 is formed on the under side of the second insulating substrate 34. The ejection electrodes 22*b* are formed by the use of a conductive material, such as aluminum, nickel, chromium, gold or platinum, on the upper surface of the second insulating substrate 34 in the well-known manner as mentioned above. The individual ejection electrodes 22*b* are constructed so as to be in an electrically insulated state.

The suitable length of the tip part of the ejection electrodes 22*b* that protrudes forward from the tip of the first insulating substrate 33 is 2 mm or below. A reason why such a range of projection is suitable is that, when the protrusions are too long, the ink meniscus is hard to reach the point of ejection part to result in difficulty in ejection of the ink and lowering of recording frequency. In addition, it is desirable that the space between the first and the second insulating substrates 33 and 34 be from 0.1 to 3 mm. A reason why the foregoing range is desirable for the space is that too narrow space makes the ink supply difficult to result in difficulty in ejection of the ink and the lowering of recording frequency and, on the other hand, too much space makes the meniscus unstable to result in failure of consistent ejection of the ink.

The ejection electrodes 22*b* are connected to the arithmetic and control unit of image data 21. In carrying out the recording, the voltage is applied to the ejection electrodes 22*b* in accordance with the image information from the arithmetic and control unit 21, and thereby the ink on the ejection electrodes 22*b* are ejected out. Thus, the drawing is carried out on the printing plate precursor (which is not shown in the figure) arranged facing on the ejection part. The ink inflow course 37 is connected to means for sending off the ink (which is not shown in the figure) on the side opposite to the ink drops ejection direction. Further, a backing 39 is arranged apart from and facing on the under side, which is the reverse of the ejection electrodes side, of the second insulating substrate 34. Also, an ink recovery course 38 is formed between the backing and the under side of the second insulating substrate 34. It is desirable that the space of the ink recovery course 38 be at least 0.1 mm. This is because too small space makes the recovery of ink difficult and causes an ink leak. In addition, the ink recovery course 38 is connected to an ink recovery means which is attached to the ink supplying device (which is not shown in the figure).

When the uniform ink flow over the ejection part is required, the grooves 40 may be provided between the ejection part and the ink recovery part. As shown in FIG. 6 as the front-side schematic view of the neighborhood of the ejection part of an ejection head 22, a plurality of grooves 40 are cut in the slope of the second insulating substrate 34 from the vicinity of the borders with individual ejection electrodes 22*b* to the ink recovery course 38. These grooves 40 are aligned in the direction that the ink jet electrodes are arranged, and have a function that their capillary attraction conducts the ink into each of them from their individual openings on the side of ejection electrodes 22*b* and the ink conducted therein is discharged into the ink recovery course 38. Further, since each groove 40 sucks in a definite amount of ink present in the vicinity of the tip of each ejection electrode 22*b* by the action of capillary attraction depending on the opening diameter, it also has a function that it forms an ink flow having a uniform thickness in the vicinity of the tip of each ink jet electrode. The grooves 40 each may have any shape as far as it can provide a capillary attraction. However, it is especially desirable that the width of each groove be from 10 to 200 m and the depth thereof be from 10 to 300 m. In addition, the grooves 40 are provided in numbers required for forming a uniform ink flow all over the head 22.

From the viewpoint of forming high-quality images, such as clear printing, it is desirable that the tip of each ejection electrode 22*b* be made as narrower as possible. Although it depends on conditions, the tip width of each electrode is generally from 5 to 100 m.

Figure 7:
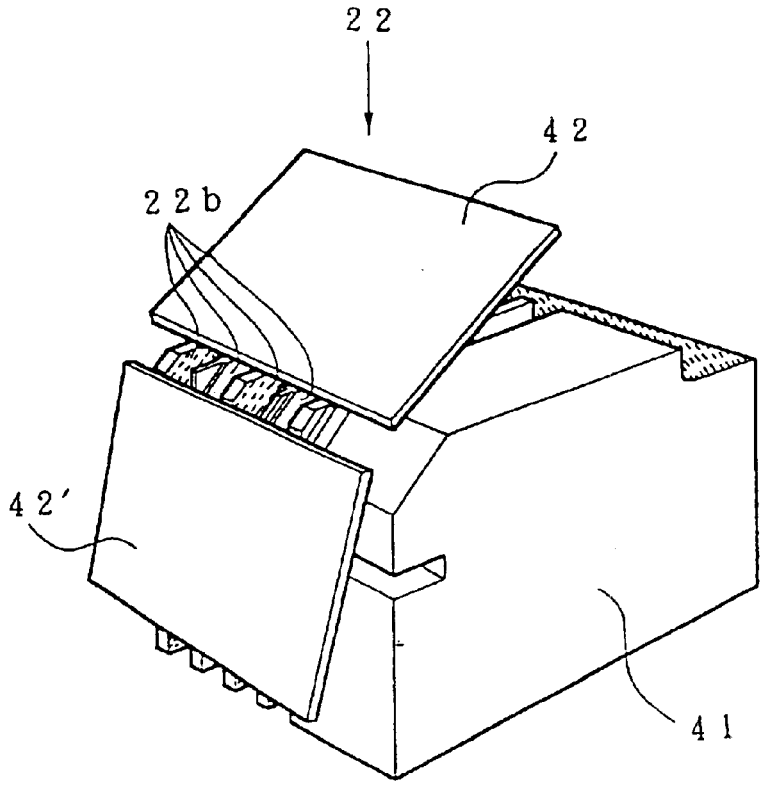
FIG. 7 is a schematically structural view showing the main part of still another example of a head which is equipped in the ink-jet recording device of the invention.
Figure 8:
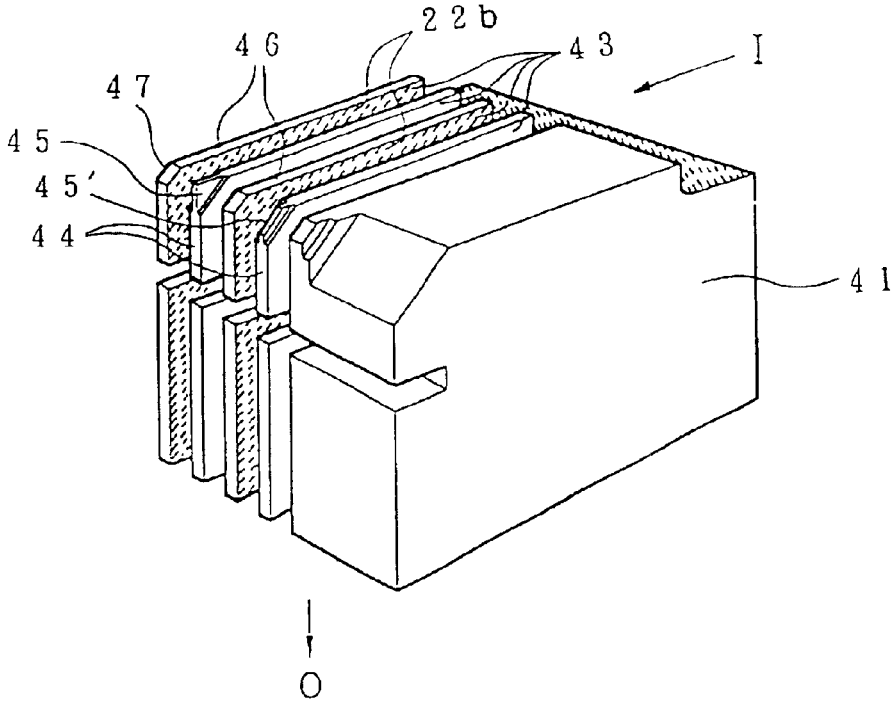
FIG. 8 is a schematically structural view of the head shown in FIG. 7 from which the regulation boards are removed.

Still another ejection head 22 used for carrying out the present invention is shown in FIGS. 7 and 8. FIG. 7 is a schematic view illustrating only a part of the head 22. The ejection head 22, as shown in FIG. 7, includes a head body 41 made of an insulating material, such as a plastic, a ceramic or glass, and meniscus regulation boards 42 and 42'. The symbol 22*b* in the figure stands for ejection electrodes 22*b* to which a voltage is applied to form an electrostatic field in the ejection part. Further, the head body 41 is illustrated in detail by reference to FIG. 8 wherein the regulation boards 42 and 42' are removed from the head 22.

The head body 41 has a plurality of ink grooves 43 cut perpendicularly to the edge thereof for the purpose of ink circulation. The grooves 43 each may have any shape as far as it can provide a capillary attraction enough to form a uniform ink flow. However, it is especially desirable that the width of each groove be from 10 to 200 m and the depth thereof be from 10 to 300 m. The ejection electrodes 22*b* are provided in the grooves 43 respectively. In each of the grooves 43, an ejection electrode 22*b* may be arranged so as to cover the whole surface of the groove or formed on only a part of the groove by a conductive material, such as aluminum, nickel, chromium, gold or platinum, according to the well-known method as adopted in another example of the head. Additionally, the ejection electrodes 22*b* are electrically isolated from one another. Two ink grooves adjacent to each other form one cell, and the partition 44 in the center of the cell has an ejection part 45 or 45' in the tip part. The partition 44 is made thinner in the ejection part 45 or 45' than the other part thereof, and the ejection part 45 or 45' is sharpened. The head body 41 having the shape as mentioned above is made using a conventional method, such as mechanical processing or etching of an insulating material block, or molding of an insulating material. It is desirable that the partition in the ejection part 45 or 45' have a thickness of from 5 to 100 m and the sharpened tip thereof have a curvature radius of from 5 to 50 m. Additionally, the tip of the ejection part 45 or 45' may be slightly cut off as the ejection part 45" shows. In addition, only two cells are depicted in the figure for the sake of convenience. Between two cells, a partition 46 is disposed, and the tip part thereof 47 is cut off so as to stand back, compared with the ejection parts 45 and 45'. The ink is flowed into the head 22 via ink grooves from the direction of I with the ink sending-off means of an ink supplying device, which is not shown in the figure, and thereby supplied to the ejection parts 45 and 45'. Further, the excess ink is recovered in the direction O with an ink recovering means, which is not shown in the figure, too. As a result, fresh ink is always supplied to each ejection part 45 and 45'. While keeping this condition, a potential difference according to the image information is applied between each ink jet electrode and the plate cylinder holding a printing plate precursor on the surface, which is not shown in the figure but arranged so as to face on the ejection part. By the voltage applied, the ink is ejected out from the ejection part to form the image on the printing plate precursor.

Still another example of the ejection head 22 is illustrated by reference to FIG. 9. As shown therein, the ejection head 22 has a pair of nearly rectangular plate-shaped support members 50 and 50'. Each of these support members 50 and 50' is made of an insulating plastic, glass or ceramic plate having a thickness of 1–10 mm, and in one face thereof are cut a plurality of rectangular grooves extending parallel to one another 51 or 51' (which are not shown in the figure). The number of grooves 51 or 51' cut in each support member 50 or 50' depends on the resolution required for recording images. For each of the grooves 51 and 51', it is desirable to have a width of from 10 to 200 m and a depth of from 10 to 300 m. In each of the grooves 51 and 51', an ejection electrode 22*b* is formed so as to cover the whole or only a part of the groove surface. As a matter of course, cutting a plurality of grooves 51 or 51' in one face of each support member 50 or 50' results in the formation of rectangular partitions 52 between respective pairs of grooves 51 or 51'. The support members 50 and 50' are put together so that their faces in which no grooves are cut are brought into contact with each other. In other words, the ejection head 22 has a plurality of grooves 51 or 51' for distribution of ink over the periphery thereof. The grooves 51 cut in the support member 50 are coupled to the corresponding grooves 51' cut in the support member 51' respectively by way of the upper end 53 of the ejection head 22. Also, each rectangular part 54 that couples two corresponding grooves 51 and 51' together stands back at a desired distance (50 to 500 m) from the upper end part 53 of the ejection head 22. In other words, each of the partitions 52 adjoining each rectangular part 54 on both sides, irrespective of which support member 50 or 50' may have them, is disposed so that the top part 55 thereof projects from adjacent rectangular parts 54. In addition, the guide protrusion 56 made of an insulating material as recited above is attached so as to project forward from each rectangular part 54 thereby forming the ejection part.

When the ink is circulated through the ejection head 22 having the structure as mentioned above, the ink is supplied to each rectangular part 54 via each of the grooves 51 formed at the periphery of the support member 50, and discharged via each of the grooves 51' cut in the support member 50' opposite to the support member 50. In this case, an inclination of a definite angle is given to the ejection head 22 in order to enable the smooth ink circulation. In other words, the ejection head 22 has such slopes that the ink supply side (of the support member 50) is situated upward and the ink discharge side (of the support member 50') is situated downward. By circulating the ink through the ejection head 22 in the foregoing manner, the ink passing across each rectangular part 54 flows forward along each protrusion 56 to form an ink meniscus in the vicinity of the rectangular part 54 and the protrusion 56. In the situation that independent ink meniscuses are formed on individual rectangular parts 54, a potential difference according to the image information is applied between each ejection electrode 22*b* and the plate cylinder holding a printing plate precursor on the surface, which is not shown in the figure but arranged so as to face on the ejection part. As a result, the ink is jetted out from the ejection part to form the image on the printing plate precursor. On the other hand, a cover may be attached along the periphery of each of the support members 50 and 50' to cover up the grooves, thereby forming pipe-shaped ink flow courses along the periphery of each of the support members 50 and 50'. In this case, the ink can be forcedly circulated by way of these ink flow courses so it becomes unnecessary to give slopes to the ejection head 22.

Each of the heads 22 shown in FIGS. 3 to 7 can have a maintenance device, such as cleaning means, if needed. For instance, in a case where the drawing operation is suspended for a certain period or develops image quality troubles, the means for circulating the ink solvent alone, which is for exerting suction on the ejection part while supplying or circulating the ink solvent alone, and which is for wiping the tip of ejection head on a flexible brush or cloth, can be adopted alone or in combination thereby effectively preventing ink from solidifying inside the ejection head. As a result, satisfactory drawing conditions can be maintained. In addition, it is also effective to keep the ejection head in a cover filled with a solvent vapor. These means can be used alone or in combination.

Moreover, a multicolor one-sided lithographic printing press forming a lithographic printing plate therein as an example of the multicolor printing apparatus used in the invention is illustrated below.

FIG. 10 is the schematically overall structural view showing a four-color one-sided lithographic printing press forming a lithographic printing plate therein. As shown in FIG. 10, the four-color one-sided printing press has a structure constituted basically of four single-color one-sided printing presses as shown in FIG. 1, which each have a plate cylinder 11, a blanket cylinder 12 and an impression cylinder 13, and which are arranged so as to perform multiple printings on the same surface of printing paper. Additionally, the delivery of printing paper between the adjacent impression cylinders, which is symbolized by K in the figure, is carried out using a known transfer cylinder system which is not illustrated in the figure. As is easily apparent from FIG. 10 as an example, other multicolor one-sided printing presses, although the detailed description thereof is omitted, basically have a similar structure to the above. Specifically, a plurality of single-color one-sided printing presses, which each have the plate cylinder 11, the blanket cylinder 12 and the impression cylinder 13, are arranged so as to perform multiple printings on the same side of printing paper. In a case where only one of the printing plates different in color is made on one plate cylinder, the number of plate cylinders required and the number of blanket cylinders required are each the same as the number of colors to be printed. In another case where at least two printing plates different in color are made on one plate cylinder, the number of plate cylinders required and the number of blanket cylinders required are each the number obtained by dividing the number of colors to be printed by the number of printing plates made on one plate cylinder. For instance, when two printing plates different in color are formed on one plate cylinder, triple-color or quadruple-color printings can be accomplished by the use of two plate cylinders and two blanket cylinders. As to the impression cylinders, they may be provided in the same number as the plate cylinders used, but one impression cylinder can be shared among some plate cylinders and blanket cylinders. If needed, means for keeping the printing paper on the plate cylinder until the printings of desired colors are finished can be attached to the plate cylinder.

In embodying the present invention in a multicolor both-sided lithographic printing press forming a lithographic printing plate therein, the printing press illustrated above is equipped with a known means for reversing printing paper or the printing press is structured to allow the printing on both sides of printing paper P by having a plurality of combinations made with the plate cylinder 11 and the blanket cylinder 12 of the single-color one-sided printing press shown in FIG. 1. In the case of making only one among the printing plates different in color on one plate cylinder, the number of plate cylinders required and that of blanket cylinders required are each the same as the number of colors printed on both sides of printing paper. In the other case of making at least two printing plates different in color on one plate cylinder, the number of plate cylinders and the number of blanket cylinders can be reduced as mentioned above. When one impression cylinder is shared among some plate cylinders and blanket cylinders, the number of impression cylinders can be reduced, too. Means for keeping the printing paper on the plate cylinder until the printings of desired colors are completed can be attached to each of the plate cylinders, if needed. A description of the details is omitted because the foregoing description of the multicolor one-sided lithographic printing press forming lithographic printing plate therein provides a good understanding.

As a further example of the lithographic printing press forming lithographic printing plate therein, mention may be made of a printing press structured so that two plate cylinders are disposed for every blanket cylinder to make it possible to perform the printing on one plate cylinder and the drawing on the other plate cylinder at the same time. In this case, it is desirable that the driving of the plate cylinder on which the drawing is carried out be mechanically independent of that of the blanket cylinder. By such an independent driving, it becomes possible to carry out the drawing operation without a temporary suspension of printing. Additionally, as can be easily understood, such a system can be applied to both a multicolor one-sided lithographic printing press forming lithographic printing plate therein and a multicolor both-sided lithographic printing press forming lithographic printing plate therein.

Now, the plate (printing plate precursor) which can be used in the present invention will be described in greater detail below.

A metal plate such as an aluminum plate or a steel plate plated with chromium is usually employed as the plate. An aluminum plate subjected to graining and anodizing treatment is particularly preferred because of excellent water-retention and anti-abrasion properties of the surface thereof. Also, a plate including a water-resistant support such as paper subjected to water-resistant treatment, a plastic film or paper laminated with plastic, having provided thereon an image-receiving layer is employed from an economic standpoint. The thickness of the image-receiving layer is ordinarily in a range of from 5 to 30 m.

The image-receiving layer includes a hydrophilic layer including an inorganic pigment, a binder and a layer capable of being rendered hydrophilic upon an oil-desensitizing treatment.

The inorganic pigment used in the hydrophilic image-receiving layer includes clay, silica, calcium carbonate, zinc oxide, aluminum oxide and barium sulfate. The binder used includes a hydrophilic binder, for example, polyvinyl alcohol, starch, carboxymethyl cellulose, hydroxyethyl cellulose, casein, gelatin, a salt of polyacrylic acid, polyvinyl pyrrolidone and a methyl ether-maleic anhydride copolymer. Further, in order to impart water-resistance to the image-receiving layer, a melamine formaldehyde resin, a urea formaldehyde resin or other cross-linking agents may be added thereto, if desired.

The weight ratio of inorganic pigment/binder is preferably from 30/70 to 80/20.

The image-receiving layer to which an oil-desensitizing treatment is applied includes, for example, a layer including zinc oxide and a hydrophobic binder.

The zinc oxide used in the image-receiving layer according to the present invention is any of zinc oxide, zinc white, wet-type zinc white, and activated zinc white as commercially available and as described in "Shinban Ganryo Binran (New Edition of Pigment Handbook)", Nippon Ganryo Gijutsu Kyokai, ed., pp. 319, Kabushiki Kaisha Seibundo (1968).

Specifically, depending on starting materials and production methods, zinc oxide is classified into two groups, that produced by a wet method and that produced by a dry method which are further subclassified into zinc oxide produced by the French method (indirect method) and that produced by the American method (direct method).

Suitable examples of zinc oxide are those commercially available from Seido Kagaku Kogyo K.K., Sakai Chemical Industry Co., Ltd., Hakusui Chemical Industries, Ltd., Honjo Chemical K.K., Toho Zinc Co., Ltd., and Mitsui Mining & Smelting Co., Ltd.

A resin suitable for the hydrophobic binder includes a styrene copolymer, a methacrylate copolymer, an acrylate copolymer, a vinyl acetate copolymer, polyvinyl butyral, an alkid resin, an epoxy resin, an epoxy ester resin, a polyester resin and a polyurethane resin. The resins may be employed individually or as a mixture of two or more thereof.

The content of the resin in the image-receiving layer is from 9/91 to 20/80 in terms of a weight ratio of resin/zinc oxide.

The oil-desensitizing treatment of the image-receiving layer containing zinc oxide is conducted using an oil-desensitizing solution in a conventional manner. Suitable examples of the oil-desensitizing solution include those conventionally known, for example, a treating solution containing a cyan compound such as ferrocyanate or ferricyanate as the main component, a cyan-free treating solution containing an amine cobalt complex, phytic acid or a derivative thereof, or a guanidine derivative as the main component, a treating solution containing an inorganic or organic acid capable of forming a chelate with a zinc ion as the main component, and a treating solution containing a water-soluble polymer.

For instance, the treating solutions containing a cyan compound include those described for example in JP-B44-9045 (the term "JP-B" as used herein means an "examined Japanese patent publication"), JP-B46-39403, JP-A-52-76101, JP-A-57-107889 and JP-A-54-117201.

Now, the oil-based ink which can be used in the present invention is described in more detail below.

The oil-based ink used in the present invention is a dispersion including hydrophobic resin particles which are solid at least at an ordinary temperature (i.e., 15° C. to 35° C.) dispersed in a nonaqueous solvent, preferably having an electric resistance of $10^9$ Ωcm or more and a dielectric constant of 3.5 or below. By using such a nonaqueous solvent as a dispersing medium, the electric resistance of the oil-based ink can be controlled appropriately. As a result, the ejection of ink by the action of an electrostatic field can be properly carried out whereby the image quality is more improved.

Preferred examples of the nonaqueous solvent having an electric resistance of $10^9$ Ωcm or more and a dielectric constant of 3.5 or below include straight chain or branched aliphatic hydrocarbons, alicyclic hydrocarbons, aromatic hydrocarbons and halogenated products of these hydrocarbons. Specific examples thereof include hexane, heptane, octane, isooctane, decane, isodecane, decaline, nonane, dodecane, isododecane, cyclohexane, cyclooctane, cyclodecane, benzene, toluene, xylene, mesitylene, ISOPAR® C, ISOPAR® E, ISOPAR® G, ISOPAR® H and ISOPAR® L (ISOPAR®: trade name, product of Exxon Corp.), Shellsol 70 and Shellsol 71 (Shellsol: trade name, product of Shell Oil Corp.), AMSCO® OMS and AMSCO® 460 solvent (AMSCO®: trade name, product of American Mineral Spirits Corp.), and silicone oils.

They can be used individually or as a mixture of two or more thereof. As to the nonaqueous solvent, the upper limit of the electric resistance value is of the order of $10^{16}$ Ωcm, and the lower limit of the dielectric constant value is about 1.9.

When the electric resistance of the nonaqueous solvent used is too low beyond the foregoing range, the resulting ink cannot have an appropriate electric resistance such that the ejection of ink by the action of an electrostatic field becomes poor. On the other hand, when the dielectric constant of the nonaqueous solvent used is too high beyond the foregoing range, the electrostatic field is apt to be relaxed due to polarization of the solvent and therefore poor ejection of the ink tends to occur.

The resin particles dispersed in the nonaqueous solvent as described above are hydrophobic resin particles which are solid at a temperature of 35° C. or below and have good affinity with the nonaqueous solvent. As such a hydrophobic resin, a resin (P) having a glass transition temperature of from −5° C. to 1100° C. or a softening temperature of from 33° C. to 140° C. is preferred. The more preferable range of the glass transition temperature is from 10° C. to 100° C. and that of the softening temperature is from 38° C. to 1200° C. In particular, it is preferred for the resin (P) to have a glass transition temperature of from 15° C. to 80° C. or a softening temperature of from 38° C. to 100° C.

By using a resin having such a glass transition temperature or a softening temperature as described above, the affinity of each resin particle with the surface of the printing plate precursor is enhanced and the resin particles are firmly bonded with each other on the printing plate precursor. Thus, the adhesion of the ink image to the printing plate precursor is increased and the press life is improved. On the contrary, if the glass transition temperature or a softening temperature of the resin used is beyond the upper and lower limits specified above, the affinity of each resin particle with the surface of the printing plate precursor may be lowered and the bond between resin particles may be weakened.

The weight average molecular weight (Mw) of the resin (P) is preferably from $1\times10^3$ to $1\times10^6$, more preferably from $5\times10^3$ to $8\times10^5$, and yet more preferably from $1\times10^4$ to $5\times10^5$.

Example of such a resin (P) include olefin homopolymers and copolymers (such as polyethylene, polypropylene, polyisobutylene, ethylene-vinyl acetate copolymer, ethylene-acrylate copolymer, ethylene methacrylate copolymer and ethylene-methacrylic acid copolymer), vinyl chloride homopolymers or copolymers (such as polyvinyl chloride and vinyl chloride-vinyl acetate copolymer), vinylidene chloride copolymers, vinyl alkanoate homopolymers and copolymers, allyl alkanoate homopolymers and copolymers, homopolymers and copolymers of styrene and derivatives thereof (such as butadiene-styrene copolymer, isoprene-styrene copolymer, styrene-methacrylate copolymer and styrene-acrylate copolymer), acrylonitrile copolymers, methacrylonitrile copolymers, alkyl vinyl ether copolymers, acrylate homopolymers and copolymers, methacrylate homopolymers and copolymers, itaconic acid diester homopolymers and copolymers, maleic anhydride copolymers, acrylamide copolymers, methacrylamide copolymers, phenol resins, alkyd resins, polycarbonate resins, ketone resins, polyester resins, silicone resins, amide resins, hydroxyl and carboxyl-modified polyester resins, butyral resins, polyvinylacetal resins, urethane resins, rosin resins, hydrogenated rosin resins, petroleum resins, hydrogenated petroleum resins, maleic acid resins, terpene resins, hydrogenated terpene resins, chroman-indene resins, cyclized rubber-methacrylate copolymers, cyclized rubber-acrylate copolymers, copolymers containing a heterocyclic ring containing no nitrogen atom (as the heterocyclic ring, e.g., furan ring, tetrahydrofuran ring, thiophene ring, dioxane ring, dioxofuran ring, lactone ring, benzofuran ring, benzothiophene ring and 1,3-dioxetane ring), and epoxy resins.

It is desirable for the resin particles to be contained in the oil-based ink in an amount of from 0.5 to 20% by weight based on the total ink. When the amount of the resin particles is lower than 0.5% by weight, it becomes hard for the ink to have an affinity with the printing plate precursor and as a result, the ink may not form images of good quality and the press life tends to decrease. When the proportion of the resin particles is increased beyond the foregoing range, on the other hand, it is difficult to form a homogeneous dispersion and as a result, the ink is apt to clog an ejection head and stable ink ejection may not be achieved.

For the oil-based ink used in the present invention, it is preferred to contain a coloring material, as a colored component, together with resin particles in order to easily conduct visual inspection of the resulting printing plate after plate-making or the like.

Such a coloring material may be any of pigments and dyes which have been ordinarily used in conventional oil-based ink compositions and liquid developers for electrostatic photography.

The pigments used have no particular restriction, and include both inorganic and organic pigments which are ordinarily used in the field of printing. Examples of pigment usable in the oil-based ink include carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perynone pigments, thioindigo pigments, quinophthalone pigments, metal complex pigments, and other conventionally known pigments.

As the dyes, oil-soluble dyes are suitable for use in the oil-based ink, with examples including azo dyes, metal complex dyes, naphthol dyes, anthraquinone dyes, indigo dyes, carbonium dyes, quinoneimine dyes, xanthene dyes, cyanine dyes, quinoline dyes, nitro dyes, nitroso dyes, benzoquinone dyes, naphthoquinone dyes, phthalocyanine dyes and metallophthalocyanine dyes.

The pigments and dyes may be used individually, or they can be used in an appropriate combination. It is desirable that they are contained in a proportion of from 0.01 to 5% by weight based on the total ink.

Such a coloring material as described above may be dispersed into the nonaqueous solvent as dispersed particles separately from the resin particles, or it may be incorporated into the resin particles dispersed in the nonaqueous solvent. In the latter case, the incorporation of a pigment is ordinarily effected by coating the pigment with the resin material of resin particles to form resin-coated particles, while the incorporation of a dye is ordinarily affected by coloring the surface portion of resin particles with the dye to form colored particles.

The average diameter of the resin particles, including colored particles, dispersed in the nonaqueous solvent is preferably from 0.05 to 5 m, more preferably from 0.1 to 1.0 m, and yet more preferably from 0.1 to 0.5 m. The diameter of the particle is determined with a particle size analyzer, CAPA-500 (trade name, manufactured by Horiba Ltd.).

The nonaqueous dispersion of resin particles used in the present invention can be prepared using a well-known mechanical grinding method or a polymerization granulation method. In the mechanical grinding method, the materials for forming resin particles are mixed, molten and kneaded, if needed, and directly ground into fine particles with a conventional grinder, and further dispersed in the presence of a dispersing polymer by means of a conventional wet-type dispersing machine (e.g., a ball mill, a paint shaker, a Keddy mill, a Dyno mill). In another mechanical grinding method, the materials for forming resin particles and a dispersion assisting polymer (a covering polymer) are kneaded in advance to form a kneaded matter, then ground into fine particles, and further dispersed in the presence of a dispersing polymer. Methods of preparing paints or liquid developers for electrostatic photography can be adopted in practice. Details of these methods are described, e.g., in *Flow of Paints and Dispersion of Pigments*, translated under the supervision of Kenji Ueki, Kyoritsu Shuppan (1971), Solomon, *Paint Science, Paint and Surface coating and Theory and Practice*, Yuji Harasaki, *Coating Engineering*, Asakura Shoten (1971), and Yuji Harasaki, *Elementary Course of Coating Science*, Maki Shoten (1977).

For the polymerization granulation method, well-known methods for dispersion polymerization in nonaqueous media can be employed. Details of such methods are described, e.g., in *The Newest Technology of Super-Fine Polymer Particles*, chapter 2, edited under the supervision of Soichi Muroi, CMC Shuppan (1991), *The Latest Systems for Electrophotographic Development, and Development and Application of Toner Materials*, chapter 3, edited by Koichi Nakamura, Nippon Kagaku Joho K. K. (1985), and K. B. J. Barrett, *Dispersion Polymerization in Organic Medium*, John Wiley (1975).

In order to stabilize the particles dispersed in the nonaqueous solvent, the particles are generally dispersed together with a dispersing polymer (also referred to as dispersion stabilizing resin hereinafter sometimes). The dispersing polymer contains repeating units soluble in the nonaqueous solvent as the main component, and weight average molecular weight (Mw) thereof is preferably from $1\times10^3$ to $1\times10^6$, more preferably from $5\times10^3$ to $5\times10^5$.

Suitable examples of the soluble repeating units of the dispersing polymer usable in the present invention include a polymerizing component represented by the following formula (I):

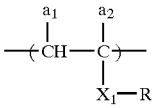

wherein $X_1$ represents —COO—, —OCO— or —O—; R represents an alkyl or alkenyl group having from 10 to 32 carbon atoms, preferably an alkyl or alkenyl group having from 10 to 22 carbon atoms, which may have a straight chain or branched structure and may be substituted, although the unsubstituted form is preferred (e.g., decyl, dodecyl, tridecyl, tetradecyl, hexadecyl, octadecyl, eicosanyl, docosanyl, decenyl, dodecenyl, tridecenyl, hexadecenyl, octadecenyl or linoleyl); and $a_1$ and $a_2$, which may be the same or different, each preferably represents a hydrogen atom, a halogen atom (e.g., chlorine or bromine), a cyano group, an alkyl group having from 1 to 3 carbon atoms (e.g., methyl, ethyl or propyl), —COO—$Z_1$ or —$CH_2$COO—$Z_1$ [wherein $Z_1$ represents a hydrocarbon group having not more than 22 carbon atoms which may be substituted (such as an alkyl, alkenyl, aralkyl, alicyclic or aryl group) including preferably an unsubstituted or substituted alkyl group having from 1 to 22 carbon atoms (e.g., methyl, ethyl, propyl, butyl, hexyl, heptyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethy or 3-bromopropyl), an unsubstituted or substituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl or linoleyl), an unsubstituted or substituted aralkyl group having from 7 to 12 carbon atoms (e.g., benzyl, phenetyl, 3-phenylpropyl, naphthylmethyl, 2-naphthylethyl, chlorobenzyl, bromobenzyl, methylbenzyl, ethylbenzyl, methoxybenzyl, dimethylbenzyl or dimethoxybenzyl), an unsubstituted or substituted alicyclic group having from 5 to 8 carbon atoms (e.g., cyclohexyl, 2-cyclohexylethyl or 2 cyclopentyl ethyl) and an unsubstituted or substituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl or dodecyloylamidophenyl)].

In addition to the repeating units represented by formula (I), the dispersing polymer may contain other repeating units as copolymerizing components. The copolymerizing components may be derived from any monomer as far as they can be copolymerized with the monomers corresponding to the repeating units of formula (I).

A suitable proportion of the repeating unit represented by formula (I) in the dispersing polymer is preferably at least 50% by weight, more preferably at least 60% by weight.

Suitable examples of the dispersing polymer include those described, for example, in JP-A-10-204354, JP-A-10-204356, JP-A-10-259336, JP-A-10-306244, JP-A-10-316917, JP-A-10316920 and JP-B-640229.

Specific examples of the dispersing polymer include Dispersion Stabilizing Resin (Q-1) used in the Examples described hereinafter and commercially available products, e.g., Sorprene 1205 manufactured by Asahi Chemical Industry Co., Ltd.

To prepare the foregoing resin (P) particles in an emulsion (latex) state, it is preferred that the dispersing polymer is added prior to the polymerization.

In the case of using a dispersing polymer, the proportion of the dispersing polymer to the resin (P) particle is from about 1 to about 50% by weight.

In the oil-based ink employed in the present invention, it is desirable that the dispersed resin particles and colored particles (the particles of coloring material) be electroscopic particles charged positively or negatively.

In order to impart the electroscopicity to those particles, the technology of a wet developer for electrostatic photography can be appropriately utilized. Specifically, the electroscopicity can be imparted to the particles by using electroscopic materials, for example, charge control agents and other additives as described, e.g., in *The Latest Systems for Electrophotographic Development, and Development and Application of Toner Materials*, pp. 139–148, described above, *The Fundamentals and Applications of Electrophotographic Techniques*, edited by Electrophotographic Society, pp. 497–505, Corona Co. (1988), and Yuji Harasaki, *Electrophotography* vol. 16 (No. 2), p. 44 (1977).

In addition, details of those materials are described, for example, in British Patents 893,429 and 934,038, U.S. Pat. Nos. 3,900,412 and 4,606,989, JP-A-60-179751, JP-A-60-185963 and JP-A-2-13965.

The charge control agent as described above is preferably used in an amount of from 0.001 to 1.0 parts by weight per 1,000 parts by weight of dispersing medium as a carrier liquid. Furthermore, various kinds of additives can be added, but the total amount of additives has an upper limit because it is restricted by the electric resistance allowable for the oil-based ink used in the present invention. More specifically, when the ink has an electric resistance of lower than $10^9$ Ωcm in the condition that the dispersed particles are removed from the ink, the formation of a continuous gradation image having good quality may become difficult. Therefore, it is required that the amount of each additive added be controlled within the above described limitation.

According to the method of the present invention, a large number of prints having clear images can be obtained. Further, a printing plate is directly formed corresponding to digital image data in a printing press, and lithographic printing is performed at a low cost and a high speed.

The preferred embodiments of the invention are described below:

(1) A method of lithographic printing, which includes forming an image based on signals of image data directly on a printing plate precursor mounted on a plate cylinder of a printing press, thereby preparing a printing plate, and conducting lithographic printing, wherein the formation of an image on the printing plate precursor is carried out by an ink jet recording method in which oil-based ink is ejected utilizing an electrostatic field.

(2) The method of lithographic printing as described in Embodiment (1), wherein the oil-based ink is a dispersion including hydrophobic resin particles which are solid at least at an ordinary temperature dispersed in a nonaqueous solvent having an electric resistance of at least $10^9$ Ωcm and a dielectric constant of 3.5 or less.

(3) The method of lithographic printing as described in Embodiment (1), further including using a device for fixing the image on the printing plate precursor.

(4) The method of lithographic printing as described in any of Embodiments (1) to (3), further including using means for removing dust which is present on the surface of the printing plate precursor before and/or during drawing of an image on the printing plate precursor.

(5) The method of lithographic printing as described in any of Embodiments (1) to (4), wherein the rotation of the plate cylinder on which the printing plate precursor is mounted affects the main scanning for drawing images on the printing plate precursor.

(6) The method of lithographic printing as described in Embodiment (5); the formation of an image on the printing plate precursor by the ink jet recording method is carried out using an ink jet recording device equipped with a single or multiple head, and the head is slid in the axis direction of the plate cylinder to accomplish the sub-scanning for drawing images on the printing plate precursor.

(7) The method of lithographic printing as described in Embodiment (5), wherein the ink jet recording device is equipped with a full line head having almost the same length as the width of the plate cylinder.

(8) The method of lithographic printing as described in Embodiments (1) to (7), wherein the ink jet recording device is further equipped with means for supplying the oil-based ink to the head.

(9) The method of lithographic printing as described in Embodiments (1) or (7), wherein the ink jet recording device is further equipped with a combination of means for supplying the ink to the head and means for recovering the ink from the head to perform the ink circulation.

(10) The method of lithographic printing as described in any of Embodiments (1) to (9), wherein the oil-based ink is stored in an ink tank having means for stirring inside the ink tank.

(11) The method of lithographic printing as described in any of Embodiments (1) to (10), wherein the ink tank further has means for controlling the ink temperature inside the ink tank.

(12) The method of lithographic printing as described in any of Embodiments (1) to (11), wherein the ink tank further has means for controlling the ink concentration inside the ink tank.

(13) The method of lithographic printing as described in any of Embodiments (1) to (12); wherein the head in the ink jet recording method is installed so that it is kept close to the plate cylinder at the time when the images are drawn on the printing plate precursor and at other times, it is kept away from the plate cylinder, with means for moving the head near or away.

(14) The method of lithographic printing as described in any of Embodiments (1) to (13), further including using means for removing the paper dust generating during the lithographic printing operations.

(15) The method of lithographic printing as described in any of Embodiments (1) to (14), further including using means for cleaning the head in the ink jet recording method at least at the completion of plate-making.

EXAMPLES

The present invention will be described in greater detail in the following examples, but the present invention should not be construed as being limited thereto.

Also, preparation of an example of a resin particle (PL) suitable for the oil-based ink used in the present invention will be described below.

Preparation Example 1

Preparation of Resin Particle (PL-1)

A mixed solution of 10 g of Dispersion Stabilizing Resin (Q-1) having the structure illustrated below, 100 g of vinyl acetate and 384 g of ISOPAR® H was heated to a temperature of 70° C. under a nitrogen gas stream with stirring. To the solution was added 0.8 g of 2,2'-azobis(isovaleronitrile) (abbreviated as A.I.V.N.) as a polymerization initiator, which was followed by a reaction for 3 hours. Twenty minutes after the addition of the polymerization initiator, the reaction mixture became white turbid, and the reaction temperature rose to 88° C. Further, 0.5 g of the above-described polymerization initiator was added to the reaction mixture, and the reaction was carried out for 2 hours. Then, the temperature of the reaction mixture was raised to 100° C., and stirred for 2 hours to remove the unreacted vinyl acetate by distillation. After cooling, the reaction mixture was passed through a nylon cloth of 200-mesh to obtain a white dispersion. In the polymerization process, the polymerization rate was 90%. The white dispersion obtained was a latex of good monodispersity having an average particle diameter of 0.23 m. The average particle diameter was measured by CAPA-500 (manufactured by Horiba Ltd.).

Dispersion Stabilizing Resin (Q-1)

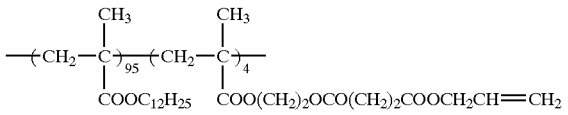

Mw: $5\times10^4$ (composition ratio: by weight)

A part of the above-described white dispersion was centrifuged at a rotation of $1\times10^4$ r.p.m. for 60 minutes and the precipitated resin particles were collected and dried. The weight average molecular weight (Mw) of the resin particles was $2\times10^5$ (a GPC value in terms of polystyrene) and the glass transition temperature (Tg) thereof was 38° C.

EXAMPLE 1

Oil-based ink was prepared in the following manner.

Oil-Based Ink (IK-1)

In a paint shaker (manufactured by Toyo Seiki K.K.), 10 g of copolymer of dodecyl methacrylate and acrylic acid (copolymerization ratio: 95/5 by weight), 10 g of nigrosine and 30 g of Shellsol 71 were placed together with glass beads, and the mixture was dispersed for 4 hours to prepare a fine dispersion of nigrosine.

A mixture of 45 g (as a solid basis) of Resin Particle (PL-1) prepared in Preparation Example 1, 20 g of the above described dispersion of nigrosine, 15 g of tetradecyl alcohol (FOC-1400 manufactured by Nissan Chemical Industries, Ltd.) and 0.08 g of copolymer of octadecene and maleic acid monooctadecylamide was diluted with one liter of ISOPAR® G to prepare an oil-based black ink.

The ink tank of the ink jet recording device of the lithographic printing press capable of forming lithographic printing plate therein (See FIG. 1 and FIG. 2) was filled with 2 liters of the oil-based ink (IK-1). Herein, a 900 dpi 64-channel multihead as shown in FIG. 3 was used as an ejection head. A throw-in type heater and stirring blades were installed as means for controlling the ink temperature in the ink tank. The ink temperature was set at 30° C., and the temperature control was carried out in a thermostat while rotating the stirring blades at 30 r.p.m. Herein, the stirring blades were also utilized as stirring means for prevention of sedimentation and aggregation. Further, a part of the ink flow course was made transparent, and the transport part is an anged between a light emission diode (LED) and a light detector. In accordance with the output signals from the light detector, the concentration control of the ink was carried out by feeding the diluent of ink (ISOPAR® G) or the concentrated ink (the solids concentration of which was adjusted to twice that of the ink (IK-1)).

The aluminum plate having a thickness of 0.12 mm which was subjected to graining and anodizing treatment was used as a printing plate precursor. The printing plate precursor was mounted on and brought into close contact with the plate cylinder by the use of a mechanical mounting device and a plate end gripper attached to the plate cylinder. The dampening water supplying device, the printing ink supplying device and the blanket cylinder are set away from the printing plate precursor, and the dust on the printing plate precursor surface was removed by air-pump suction. Thereafter, the ejection head was moved close to the printing plate precursor until it reached the drawing position, and the image data to be printed was transmitted into the arithmetic and control unit of image data. While sliding the 64-channel ejection head and, at the same time, rotating the plate cylinder, the oil-based ink was ejected out from the ejection head onto the aluminum printing plate precursor, thereby forming an image on the printing plate precursor. Therein, the ejection electrode of the ejection head used had a tip width of 10 m, and the distance between the head and the printing plate precursor was kept at 1 mm by utilizing the output from an optically gap-detecting device. During the course of ejection, the voltage of 2.5 KV was always applied as a bias voltage, and thereon 500 V of pulse voltage was further superimposed for each ejection of ink. The duration of pulse voltage was changed stepwise from 0.2 millisecond to 0.05 millisecond with 256 steps, and thereby the dot area upon drawing was changed. The image drawn on the printing plate precursor had no defects due to dust, and the deterioration of image quality attributable to a change in dot size was not observed at all even when the open-air temperature varied during the plate-making and the number of plates made with this apparatus was increased. In other words, the printing press of the present invention enabled high-quality plate-making.

The image drawn on the printing plate precursor was strengthened by heating with a xenon flash fixing device (made by Ushio Electric Inc.) under the luminous intensity of 200 J/pulse, thereby making a printing plate. Then, the ink jet recording device was moved away together with the sub-scanning means from the position neighboring the plate cylinder and kept apart at a distance of 50 mm from the plate cylinder for the purpose of protecting the ejection head. Thereafter, the printing was performed on printing paper in a conventional lithographic printing process as mentioned hereinbefore. Specifically, the printing ink and dampening water were applied to the printing plate to form the printing image, and the printing ink image was transferred onto the blanket cylinder rotating in concert with the plate cylinder. Further, the printing ink image on the blanket cylinder was transferred onto the coating paper (printing paper) passing between the blanket cylinder and the impression cylinder.

The print after printing 10,000 sheets had a very clear image without generating any disappearance of the image. At the conclusion of plate-making, the head was cleaned by supplying ISOPAR® G to the head for 10 minutes and dripping the ISOPAR® G from the opening of the head. Further, the head was stored in a cover filled with vapor of ISOPAR® G. By this treatment, prints of good quality were produced for three months without any other working for maintenance.

EXAMPLE 2

Figure 9:
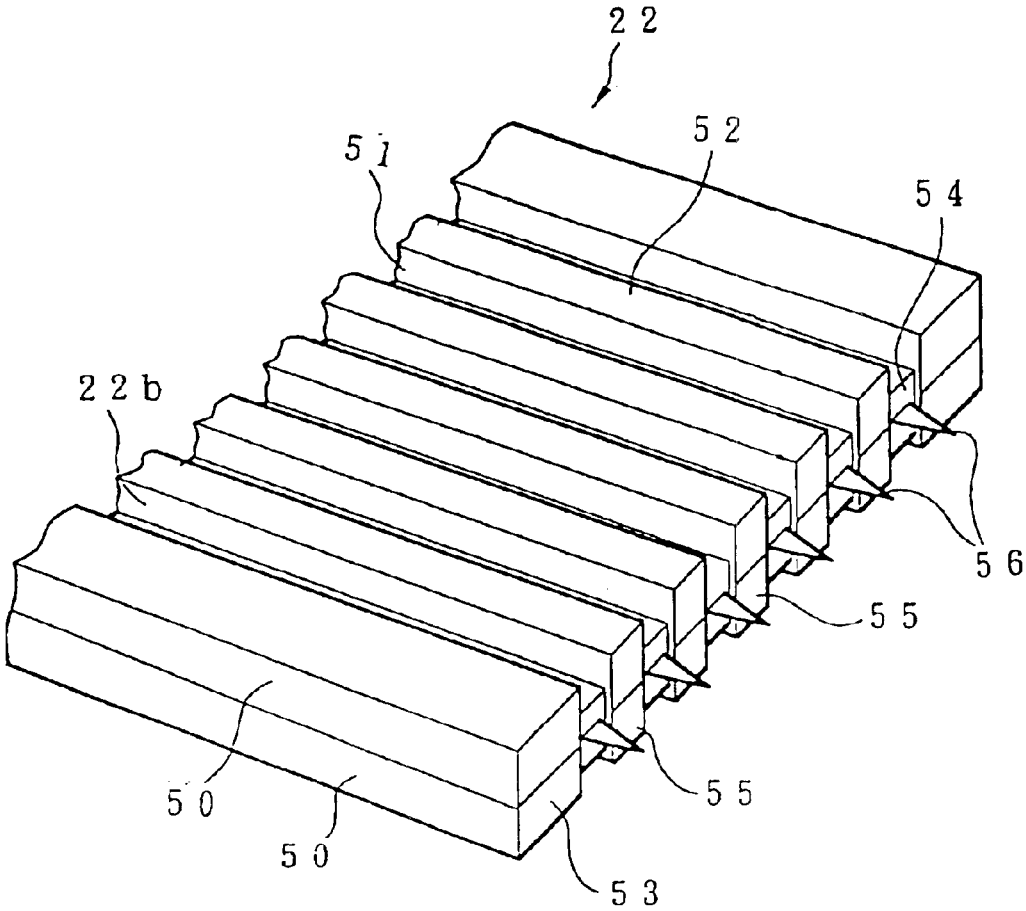
FIG. 9 is a schematically structural view showing the main part of a further example of a head which is equipped in the ink jet recording device of the invention.
Figure 10:
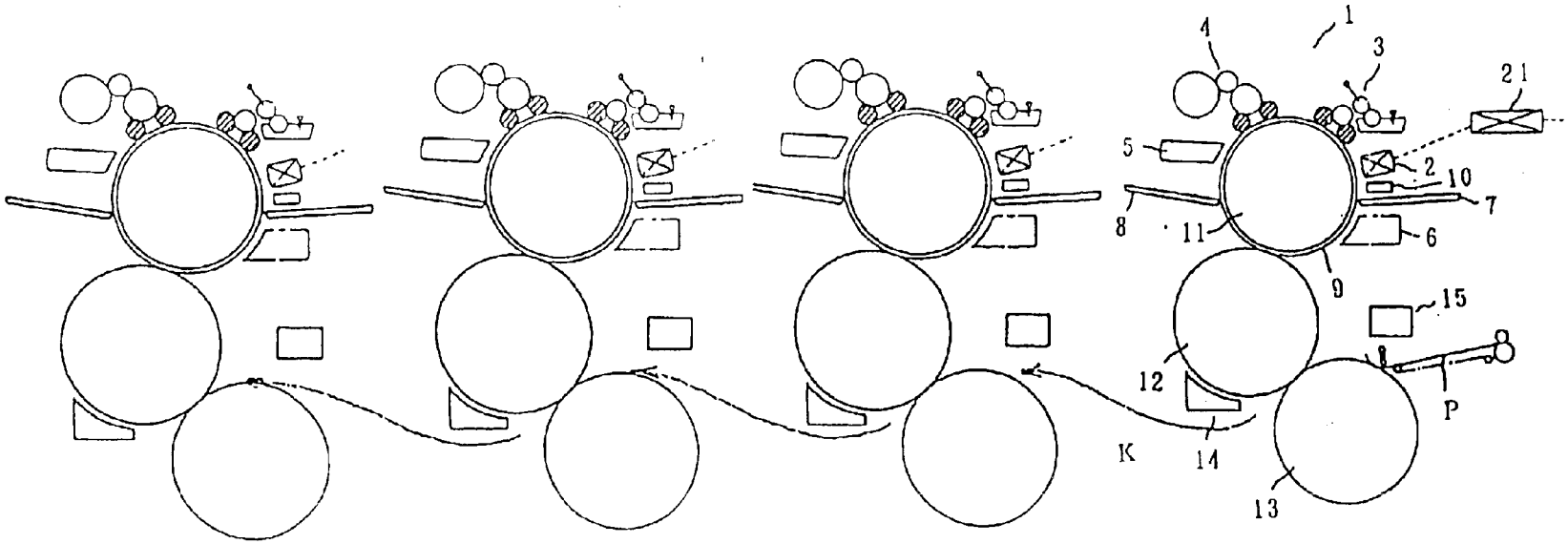
FIG. 10 is a schematically structural view showing a four-color one-sided lithographic printing press forming a lithographic printing plate therein as an example of the multicolor printing press used in the invention.

A circulatory pump was used as stirring means for the oil-based ink, and 600 dpi full-line ejection heads of the types shown in FIG. 5, FIG. 7 and FIG. 9 were each used. One ink reservoir was arranged between the pump and the ink flow-in course of the ejection head, and the other ink reservoir was arranged between the ink recovery course of the ejection head and the ink tank, and the ink was circulated by the difference in hydrostatic pressure between those reservoirs in addition to the action of the circulatory pump. Further, the combination of the circulatory pump with a heater was used as a means for controlling ink temperature, and the ink temperature was set at 35° C. and controlled in a thermostat. Herein, the circulatory pump was further used as a stirring means for preventing sedimentation and aggregation. The ink flow course was provided with a conductance measuring device. Further, according to the output signals from this device, the concentration control of the ink was carried out by diluting the ink or injecting the concentrated ink. The same aluminum sheet as prepared in Example 1 was used as a printing plate precursor, and mounted on and firmly fixed to the plate cylinder of the lithographic printing press in the same manner as in Example 1. The printing plate precursor surface was dusted off with a rotating brush made of nylon. Thereafter, the image data to be printed was transmitted into the arithmetic and control unit of image data, and the drawing was carried out by ejecting out the oil-based ink from the full-line head onto the aluminum printing plate precursor while rotating the plate cylinder to form the image on the printing plate precursor. The image drawn on the printing plate precursor had no defects due to dust, and the image quality deterioration attributable to a change in dot size was not observed at all even when the open-air temperature varied during the plate-making and the number of plates made with this printing press was increased. In other words, the printing press of the present invention enabled high-quality plate-making.

The printing was performed using the plate made in the foregoing manner. As a result, the print obtained had a very clear image without generating any disappearance of the image even after printing 10,000 sheets. At the conclusion of plate-making, the head was cleaned by circulating ISOPAR® G therethrough, and further by bringing nonwoven fabric impregnated with ISOPAR® G into contract with the tip of the head. By this treatment, prints of good quality were produced for three months without any other working for maintenance.

EXAMPLE 3

The same plate-making operations as in Example 1 were carried out to make 5,000 plates, except that the four-color one-sided lithographic printing press forming a lithographic printing plate therein (See FIG. 10) was used in place of the printing press shown in FIG. 1, the full-line head shown in FIG. 7 was used instead of the multihead as shown in FIG. 3 in the ink jet recording device, the adjustment of gap (0.8 mm) was carried out with a form roller made of TEFLON® and the ink concentration control was carried out by replenishing the ink tank with concentrated ink depending on the number of drawings. Therein, the images drawn on the printing plate precursors had no defects due to dust, and were not influenced by the change in open-air temperature during the plate-making. Some change in dot size was observed with an increase in the number of plates made, but it was on the permissible level. The fixation of the thus made plates was carried out using the same flash lamp as in Example 1, a heat roll (with power consumption of 1.2 kW, made by Hitachi Metal Ltd.), a halogen lamp (with power consumption of 1.5 kW, made by Ushio Electric Inc.), or ethyl acetate spray.

In the case of heat roll or halogen lamp fixation, the heat roll or the halogen lamp was controlled so as to keep the plate surface temperature at 95° C. for 20 sec. In the case of ethyl acetate spray, the amount of ethyl acetate sprayed was controlled to about 1 g/m$^2$. In every case, the full-color prints obtained had very clear images without generating any disappearance of the image even after printing 10,000 sheets.

Additionally, in the case of heat roll or halogen lamp fixation, the fixing time was greatly reduced by wrapping a heat insulator (PET film) around the plate cylinder. Further therein, the aluminum substrate was ground by contact with a conductive brush (with an electric resistance of $10^{-1}$ Ωcm, Thunderon made by Tsuchiya Co.).

EXAMPLE 4

The same procedure as in Example 1 was carried out except for using, as a printing plate precursor, a paper plate including a water-resistant support having provided thereon a hydrophilic image-receiving layer shown below in place of the aluminum plate employed in Example 1.

On a paper support including wood free paper having a basis weight of 100 g/ml, as a substrate, having provided thereon a water-resistant layer containing kaolin, polyvinyl alcohol, an SBR latex and a melamine resin as the main component, was coated Dispersion A shown below in a dry coverage of 6 g/m$^2$ to form an image-receiving layer, whereby the printing plate precursor was prepared.

Dispersion A

A mixture of 3 g of gelatin (first-class, manufactured by Wako Pure Chemical Industries Ltd.), 20 g of a 20% aqueous solution of colloidal silica (SNOWTEX® C manufactured by Nissan Chemical Industyries, Ltd.), 7 g of silica gel (SILYSIA® #310 manufactured by Fuji Silysia Chemical Co., Ltd.), 0.4 g of paraformaldehyde, as a hardening agent and 100 g of distilled water was dispersed in a paint shaker together with glass beads for 10 minutes, followed by removing the glass beads.

In the case of using wood free paper as printing paper, the plugging trouble due to paper dust occurred in part of the solid area of print obtained after printing 3,000 sheets. Therefore, the printing was performed under a condition that an air suction pump was set as a dust preventing means in the vicinity of the paper feeder. As a result, no printing troubles occurred, and clear prints without generating any disappearance of the image were obtained even after printing 5,000 sheets. However, the elongation of 0.1 mm was observed in the length direction of the A3-size (i.e., 297 mm×420 mm) print obtained after printing of 5,000 sheets.

EXAMPLE 5

The same procedure as in Example 1 were performed, except that the aluminum printing plate precursor was replaced by the printing plate precursor provided with an image-receiving layer capable of being rendered hydrophilic upon an oil-desensitizing treatment shown below, the non-image area of the printing plate made was rendered hydrophilic by using a device for desensitizing the plate surface, the conductive layer of the printing plate precursor was grounded by contact with a conductive leaf spring (made of phosphor bronze) during the drawing operation and the fixation was carried out by exposing the printing plate precursor to hot air.

Wood free paper having a basis weight of 100 g/m$^2$ was used as a substrate and, on both sides of the substrate, polyethylene film was laminated with a thickness of 20 m to make the water-resistant paper support. On one side of the prepared paper support, a conductive coating paint having the following composition was coated in a dry coating amount of 10 g/m$^2$, and further thereon a Dispersion B prepared in the manner shown below was coated in a dry coating amount of 15 g/m$^2$. Thus, the image-receiving layer was formed to obtain the printing plate precursor.

Coating Color for Conductive Layer:

The coating paint was prepared by mixing 5.4 parts of Carbon black (30% aq. soln.), 54.6 parts of clay (50% aq. soln.), 36 parts of SBR latex (solid concentration: 50%, Tg: 251 C) and 4 parts of, melamine resin (solid concentration: 80%, Sumirez Resin SR-13), and then adding water so as to obtain the total solid content of 25%.

Dispersion B:

A mixture of 100 g of dry zinc oxide, 3 g of a binder resin (B-1) of the structural formula illustrated below, 17 g of a binder resin (B-2) of the structural formula illustrated below, 0.15 g of benzoic acid and 155 g of toluene was dispersed for 8 minutes using a wet-type dispersing machine (Homogenizer made by Nippon Seiki K.K.) at 6,000 r.p.m., thereby preparing Dispersion B:

Binder Resin (B-1)

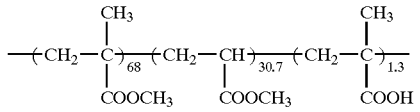

Mw9×10$^3$

Binder Resin (B-2)

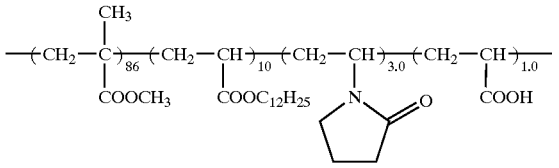

Mw4×10$^4$ (composition ratio: by weight)

The prints after printing 5,000 sheets had very clear images without generating any disappearance or sharpening of the images.

EFFECT OF THE INVENTION

In accordance with the invention, a large number of prints having clear images can be obtained. Further, a printing plate is directly formed corresponding to digital image data in a printing press, and thereby inexpensive high-speed lithographic printing is achieved.

While the invention has been described in detail and with reference to specific embodiments thereof, it will be apparent to one skilled in the art that various changes and modifications can be made therein without departing from the spirit and scope thereof.

What is claimed is:

1. A method of lithographic printing comprising forming an image based on signals of image data directly on a printing plate precursor mounted on a plate cylinder of a printing press, thereby preparing a printing plate, and conducting lithographic printing, wherein the step of forming the image on the printing plate precursor is carried out by an ink jet recording method in which oil-based ink is ejected utilizing an electrostatic field and further comprising controlling an ink concentration by feeding a concentrated ink and a diluent and fixing the oil-based ink image on the printing plate precursor by a heat roll heating, and wherein the printing plate has an image receiving layer thereon which is hydrophilic and the oil-based ink comprises electroscopic particles.

2. The method of lithographic printing as claimed in claim 1, wherein said oil-based ink is a dispersion comprising hydrophobic resin particles which are solid at least at a temperature of 15 to 35° C. dispersed in a nonaqueous solvent having an electric resistance of at least $10^9$ Ωcm and a dielectric constant of 3.5 or less.

3. The method of lithographic printing as claimed in claim 1, further comprising using means for removing dust which is present on the surface of the printing plate precursor before and/or during the step of forming the image on the printing plate precursor.

4. The method of lithographic printing as claimed in claim 1, wherein rotation of said plate cylinder on which the printing plate precursor is mounted affects main scanning during the step of forming the image on the printing plate precursor.

5. The method of lithographic printing as claimed in claim 4, wherein the step of forming the image on the printing plate precursor by the ink jet recording method is carried out using an ink jet recording device equipped with a single or multiple head, and the head is slid in the axis direction of the plate cylinder to accomplish the sub-scanning during the step of forming the image on the printing plate precursor.

6. The method of lithographic printing as claimed in claim 5, wherein said ink jet recording device is equipped with a full line head having a length almost the same as the length of the plate cylinder.

7. The method of lithographic printing as claimed in claim 6, wherein said ink jet recording device is further equipped with means for supplying the oil-based ink to the head.

8. The method of lithographic printing as claimed in claim 6, wherein the ink jet recording device is further equipped with a combination of means for supplying the oil-based ink to the head and means for recovering the oil-based ink from the head to perform an ink circulation.

9. The method of lithographic printing as claimed in claim 5, wherein said ink jet recording device is further equipped with means for supplying the oil-based ink to the head.

10. The method of lithographic printing as claimed in claim 5, wherein the ink jet recording device is further equipped with a combination of means for supplying the oil-based ink to the head and means for recovering the oil-based ink from the head to perform an ink circulation.

11. The method of lithographic printing as claimed in claim 1, wherein said oil-based ink is stored in an ink tank having means for stirring inside the ink tank.

12. The method of lithographic printing as claimed in claim 11, wherein said ink tank further has means for controlling ink temperature inside the ink tank.

13. The method of lithographic printing as claimed in claim 11, wherein said ink tank further has means for controlling ink concentration inside the ink tank.

14. The method of lithographic printing as claimed in claim 1, wherein the ink jet recording method is carried out using an ink jet recording device equipped with a single or multiple head and the head is installed so that it is kept close to the plate cylinder during the step of forming the image on the printing plate precursor and at other times, it is kept away from the plate cylinder by means for moving the head near or away.

15. The method of lithographic printing as claimed in claim 1, further comprising using means for removing paper dust generated during the lithographic printing.

16. The method of lithographic printing as claimed in claim 1, wherein the ink jet recording method is carried out using an ink jet recording device equipped with a single or multiple head and the method further comprises using means for cleaning the head in the ink jet recording method at least at the completion of plate making.

17. The method of lithographic printing as claimed in claim 1, wherein the plate cylinder is coated with a heat insulator.

* * * * *